US010426983B2

(12) United States Patent
Hennegan

(10) Patent No.: US 10,426,983 B2
(45) Date of Patent: Oct. 1, 2019

(54) FIRE SPRINKLER SYSTEM HAVING COMBINED DETECTION AND DISTRIBUTION PIPING

(71) Applicant: Michael L. Hennegan, Saint-Eustache (CA)

(72) Inventor: Michael L. Hennegan, Saint-Eustache (CA)

( * ) Notice: Subject to any disclaimer, the term of this patent is extended or adjusted under 35 U.S.C. 154(b) by 534 days.

(21) Appl. No.: 14/973,054

(22) Filed: Dec. 17, 2015

(65) Prior Publication Data

US 2016/0101306 A1 Apr. 14, 2016

Related U.S. Application Data

(63) Continuation-in-part of application No. 13/334,846, filed on Dec. 22, 2011, now Pat. No. 9,242,130.

(60) Provisional application No. 61/426,612, filed on Dec. 23, 2010.

(51) Int. Cl.

| | |
|---|---|
| ***A62C 35/62*** | (2006.01) |
| ***A62C 35/68*** | (2006.01) |
| ***A62C 37/36*** | (2006.01) |
| ***A62C 35/02*** | (2006.01) |
| ***A62C 37/14*** | (2006.01) |

(52) U.S. Cl.

CPC ..... *A62C 35/62* (2013.01); *A62C 35/023* (2013.01); *A62C 35/68* (2013.01); *A62C 37/36* (2013.01); *A62C 37/14* (2013.01)

(58) Field of Classification Search

CPC ..... A62C 35/02; A62C 35/023; A62C 35/026; A62C 35/58; A62C 35/62; A62C 35/68; A62C 37/10; A62C 37/11; A62C 37/14; A62C 37/36

See application file for complete search history.

(56) References Cited

U.S. PATENT DOCUMENTS

| | | | | |
|---|---|---|---|---|
| 2,168,244 | A | 8/1939 | Rouse | |
| 3,303,886 | A | 2/1967 | Tattersall et al. | |
| 3,473,612 | A | 10/1969 | Poitras | |
| 3,616,860 | A | 11/1971 | Willms | |
| 3,952,808 | A | 4/1976 | Richardson | |
| 4,047,571 | A | 9/1977 | Chaintrier et al. | |
| 4,058,167 | A | 11/1977 | Granek et al. | |
| 5,315,292 | A | 5/1994 | Prior | |
| 5,971,080 | A * | 10/1999 | Loh | A62C 35/66 169/17 |
| 6,076,608 | A | 6/2000 | MacDonald, III et al. | |

(Continued)

*Primary Examiner* — Darren W Gorman

(74) *Attorney, Agent, or Firm* — Norton Rose Fulbright Canada

(57) ABSTRACT

A fire sprinkler system is described which includes a piping system having at least one dual-use pipe providing both an air conveying inlet and a fire extinguishing fluid conveying outlet. The pipe has at least one air sampling opening allowing ambient air flow into the pipe and at least one fire sprinkler for ejecting a fire extinguishing fluid from the pipe in the event of a fire. An air sampling detector is fluidly connected to the pipe and tests the ambient air within the pipe to detect the presence of the fire. A valve, disposed between the source of the fire extinguishing fluid and the pipe, is in communication with the air sampling detector and operable to open, upon detection of the fire based on the ambient air tested by the air sampling detector, in order to fill the pipe with the fire extinguishing fluid.

8 Claims, 12 Drawing Sheets

(56) References Cited

U.S. PATENT DOCUMENTS

| | | | | |
|---|---|---|---|---|
| 6,443,173 | B1 | 9/2002 | Thompson, Jr. | |
| 6,685,104 | B1 | 2/2004 | Float et al. | |
| 6,985,081 | B2 | 1/2006 | Wagner et al. | |
| 7,375,642 | B2 | 5/2008 | Siemens et al. | |
| 8,132,629 | B2 | 3/2012 | Reilly et al. | |
| 8,720,591 | B2 | 5/2014 | Burkhart et al. | |
| 2005/0224240 | A1 | 10/2005 | Cosgrove | |
| 2007/0295518 | A1 | 12/2007 | Deurloo | |
| 2008/0060216 | A1* | 3/2008 | Reilly ..... | A62C 35/60 34/413 |
| 2009/0072981 | A1 | 3/2009 | Powell | |
| 2010/0263882 | A1 | 10/2010 | Bodemann | |
| 2011/0147016 | A1 | 6/2011 | Blease et al. | |
| 2012/0325502 | A1 | 12/2012 | Hennegan | |

* cited by examiner

FIRE SPRINKLER SYSTEM HAVING COMBINED DETECTION AND DISTRIBUTION PIPING

CROSS-REFERENCE TO RELATED APPLICATIONS

This application is a continuation-in-part of U.S. patent application Ser. No. 13/334,846 filed on Dec. 22, 2011, which claims priority from U.S. provisional patent application Ser. No. 61/426,612 filed on Dec. 23, 2010, the entire contents of each of which is incorporated by reference herein.

TECHNICAL FIELD

The present invention relates to the field of fire sprinkler systems, and particularly to pre-action sprinkler systems.

BACKGROUND

Dry-pipe and pre-action sprinkler systems employ sprinkler distribution piping downstream from an automatic, normally closed, valve. This distribution piping is kept free of water, for example by using a compressed gas such as air, until a fire condition exists, whereupon the valve is opened thereby flooding the distribution piping. As opposed to dry-pipe systems which rely solely on the actuation of an automatic sprinkler head to release water into the piping system, pre-action systems use a separate fire detection system to control the release of water into the distribution piping system. Two principle types of pre-action fire sprinkler systems are currently in use, namely single interlock and double interlock systems. Both such interlocked pre-action fire sprinkler systems comprise a water distribution system, having water supply and distribution piping to which fire sprinklers are connected, and a separate detection system, which may include a plurality of smoke detectors for example. Pre-action systems therefore require a supplemental detection system, which may include a plurality of smoke detectors for example, that is distinct from the water distribution system and provided in the same area as the sprinkler system.

A deluge or pre-action valve, which is integrated into the water distribution piping system, is operated depending upon activation of a smoke detector or activation of both a smoke detector and a sprinkler.

Single interlock pre-action systems only require a smoke detector to operate in order to cause the deluge valve to open, thereby flooding the piping system with water. However, water will only be discharged from the sprinkler heads when a sprinkler operates (i.e. opens) due to the heat of the fire. Double interlock pre-action systems, however, require that both a smoke detector and a sprinkler to operate (i.e. indicate the presence of smoke and fire/heat, respectively) before causing the deluge valve to open thus flooding the distribution piping system with water.

Therefore, known pre-action fire sprinkler systems include a separate water supply system and a detection system. The water supply system includes a water distribution piping network to which automatic fire sprinklers are fluidly connected. The detection system includes one or more smoke detectors that are in communication with at least a deluge valve of the water supply system. The sprinkler system is connected to a pressurized water source via the deluge valve which, when opened, allows water to flow into the piping system.

As noted above, in single-interlock pre-action systems, the deluge valve is actuated when a fire detection event occurs, e.g. the detection of smoke by a smoke detector, in order to allow water to flood the piping system and thereby flow up to the automatic fire sprinklers. In double-interlock pre-action fire sprinkler systems, actuation of at least one fire sprinkler is further required, in addition to the actuation of a smoke detector, before the deluge valve is allowed to open such as to allow water to enter into the piping system.

While being efficient, such pre-action fire sprinklers typically require a large number of smoke detectors positioned adjacent to the automatic fire sprinklers, which increases the cost and complexity of the system. Further, in double interlock systems, a pressurized gas is typically required in the piping system prior to opening of the valve in order to ensure any opening of a fire sprinkler can be detected, however the presence of such a pressurized gas in the sprinkler pipes causes a significant delay in the delivery of water to the opened sprinklers, which can lead to more expensive installations and/or less optimal response times, etc.

Therefore, there is a need for an improved fire sprinkler system.

SUMMARY

There is provided a fire sprinkler system in communication with a source of fire extinguishing fluid, the fire sprinkler system comprising: a piping system having at least one dual-use pipe providing both an air conveying inlet and a fire extinguishing fluid conveying outlet, the dual-use pipe having at least one air sampling opening therein allowing ambient air flow into the pipe and having at least one fire sprinkler fluidly connected to the pipe for ejecting said fire extinguishing fluid from the pipe in the event of detection of a fire condition; an air sampling detector fluidly connected to the pipe and testing the ambient air within the dual-use pipe, the air sampling detector being operable to detect the presence of the fire condition based on at least one characteristic detected from the ambient air within the dual-use pipe; and a valve disposed between the source of the fire extinguishing fluid and the pipe, the valve being in communication with the air sampling detector and operable to open, upon detection of the fire condition based on the ambient air tested by the air sampling detector, in order to fill the pipe with the fire extinguishing fluid.

a fire sprinkler system in communication with a source of fire extinguishing fluid, the fire sprinkler system comprising: a piping system having at least one dual-use pipe providing both an air conveying inlet and a fire extinguishing fluid conveying outlet, the dual-use pipe having at least one air sampling opening therein allowing ambient air flow into the pipe and having at least one fire sprinkler fluidly connected to the pipe for ejecting said fire extinguishing fluid from the pipe in the event of detection of a fire condition; an air sampling detector fluidly connected to the pipe and testing the ambient air within the dual-use pipe, the air sampling detector being operable to detect the presence of the fire condition based on at least one characteristic detected from the ambient air within the dual-use pipe; a suction device for drawing the ambient air into the pipe through the at least one air sampling opening therein; an anti-flood device positioned upstream of the air sampling detector, the anti-flood device allowing air flow therethrough in a direction toward said air sampling detector while preventing liquid from flowing therethrough in said direction; and a valve disposed between the source of the fire extinguishing fluid and the pipe, the valve being in communication with the air sampling detector and operable to open, upon detection of the fire condition based on the ambient air tested by the air sampling detector, in order to fill the pipe with the fire extinguishing fluid.

There is also provided a fire sprinkler system in communication with a source of fire extinguishing fluid, the fire sprinkler system comprising: a piping system having at least one dual-use pipe providing both an air conveying inlet and a fire extinguishing fluid conveying outlet, the dual-use pipe having at least one air sampling opening therein allowing ambient air flow into the pipe and having at least one fire sprinkler fluidly connected to the pipe for ejecting said fire extinguishing fluid from the pipe in the event of detection of a fire condition, the at least one air sampling opening being spaced apart on the dual-use pipe from the at least one fire sprinkler; an air sampling detector fluidly connected to the pipe and testing the ambient air within the dual-use pipe, the air sampling detector being operable to detect the presence of the fire condition based on at least one characteristic detected from the ambient air within the dual-use pipe; and a valve disposed between the source of the fire extinguishing fluid and the pipe, the valve being in communication with the air sampling detector and operable to open, upon detection of the fire condition based on the ambient air tested by the air sampling detector, in order to fill the pipe with the fire extinguishing fluid.

In accordance with another aspect of the present invention, there is provided an air sampling fire sprinkler assembly for discharging a fire extinguishing liquid, comprising: a nozzle head comprising: a discharge conduit extending therethrough between an inlet end fluidly connectable to a pipe adapted to contain the fire extinguishing liquid and a discharging end; and a cavity having a first opening fluidly connected to the discharge conduit for receiving the fire extinguishing liquid therein and a second opening fluidly connected to the discharging end for receiving air therein, the second opening providing an air sampling port through which ambient air is drawn and adapted to be fed to an air sampling detector for testing the ambient air to detect the presence of a fire condition; a heat-sensitive device substantially hermetically sealing the discharge conduit of the nozzle head and adapted to unseal the discharge conduit at a predetermined temperature to discharge the fire extinguishing liquid; and a closure device positioned within the cavity and movable between a biased open position in which the closure device is spaced apart from the second opening and a closed position in which the closure device seals the second opening, a flow of the fire extinguishing liquid within the cavity allowing the closure device to move from the biased open position to the closed position.

There is also provided, in accordance with yet another aspect of the present invention, a fire sprinkler system in communication with a source of fire extinguishing fluid, the fire sprinkler system comprising: a piping system having at least one dual-use pipe providing both an air conveying opening and a fire extinguishing fluid conveying outlet, the dual-use pipe having at least one air opening; a blower fluidly connected to the pipe to provide a substantially continuous flow of ambient air through the pipe, the ambient air entering or exiting the pipe via the at least one air opening; a control unit fluidly connected to the pipe to measure the flow of the ambient air therethrough, the control unit operable to detect a difference between a measured flow rate value of the ambient air through the pipe and a baseline flow rate value of the ambient air, a fire condition being detected by the control unit when a difference between the baseline flow rate and the measured flow rate exceeds a predetermined delta value; a valve disposed between the source of the fire extinguishing fluid and the pipe at the fluid conveying outlet, the valve being in communication with the control unit and operable to displace between an open position to fill the pipe with the fire extinguishing fluid upon detection of the fire condition, and a closed position; and at least one automatic sprinkler fluidly connected to the pipe for ejecting the fire extinguishing fluid from the pipe upon detection of the fire condition, said automatic sprinkler having a frangible component, the frangible component breaking to eject the fire extinguishing fluid from said automatic sprinkler upon an increase in temperature of the ambient air being indicative of the fire condition.

There is further provided, in accordance with yet another aspect of the present invention, a method of suppressing fire with a fire extinguishing fluid, comprising: conveying ambient air through at least one dual-use pipe having at least one air opening and at least one fire sprinkler fluidly connected to the pipe, the ambient air entering or exiting the pipe via the at least one air opening; measuring a flow of the ambient air through the pipe to obtain a measured flow rate value of the ambient air; determining a difference between the measured flow rate value and a baseline flow rate value; and filling the pipe with the fire extinguishing fluid and expelling the fire extinguishing fluid from the at least one fire sprinkler when the difference between the measured and baseline flow rate values exceeds a predetermined delta value.

BRIEF DESCRIPTION OF THE DRAWINGS

FIG. 6 is a cross-sectional view of the anti-flood device of FIG. 5, shown in a closed position;

DETAILED DESCRIPTION

Figure 1:
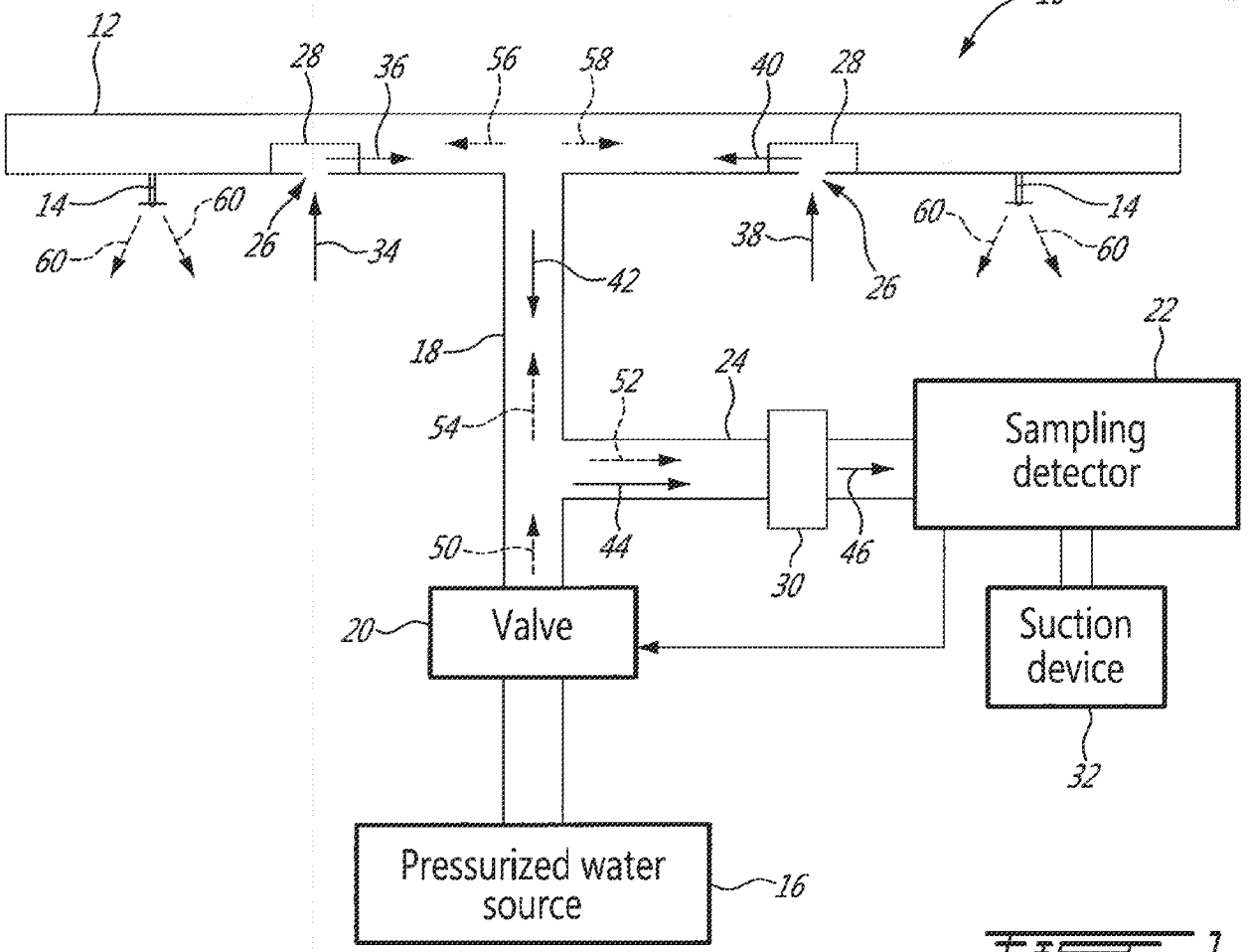
FIG. 1 is a schematic diagram illustrating a pre-action sprinkler system in accordance with one embodiment of the present disclosure.

FIG. 1 illustrates one embodiment of a fire sprinkler system 10. The system 10 comprises a piping system having at least one pipe 12, which as will be seen, is in fact a dual-use pipe providing both an air conveying inlet and a fire extinguishing fluid conveying outlet for the system 10. The dual-use pipe 12 has at least one air sampling opening therein allowing ambient air flow into the pipe and at least one fire sprinkler 14 fluidly connected to the pipe 12 for ejecting the fire extinguishing fluid (such as, but not necessarily, water) from the pipe in the event of detection of a fire condition by the system in the manner which will be described in further detail below.

The system 10 further comprises a pressurized water source 16 which is fluidly connected to the pipe 12 via a water supply pipe 18. A sprinkler system valve 20 controls the flow of pressurized water to be delivered to the water supply pipe 18. The system 10 also comprises an air sampling detector 22 which is fluidly connected to the water supply pipe 18 via a fire detection pipe 24. The air sampling detector 22 is adapted to analyze air and detect elements indicative of a potential fire within the analyzed air. In one embodiment, the sampling detector 22 is a smoke detector adapted to detect the presence of smoke in air. The sampling detector 22 and the sprinkler system valve 20 are in communication and the operation of the sprinkler system valve 20 is controlled by the sampling detector 22. Alternatively, the system 10 comprises a control unit (not shown) in communication with the sprinkler system valve 20 and the sampling detector 22. The control unit is adapted to open the sprinkler system valve 20 upon reception of a signal indicative that the sampling detector 22 has detected a potential fire. The air sampling detector 22 is therefore fluidly connected to the dual-use pipe 12 and is operable to test the ambient air within the dual-use pipe and to detect the presence of a fire condition based on at least one element detected from the ambient air within the dual-use pipe.

The water distribution and air sampling pipe 12 comprises one or more air sampling openings 26, each provided with a corresponding waterproof device 28. Each waterproof device 28 is adapted to allow gases, such as air for example, to pass therethrough while preventing liquids, such as water for example, from passing therethrough so that gases may enter the water distribution pipe 12 while a liquid flowing into the pipe 12 is prevented from exiting the water distribution pipe 12. Each of the air openings 26 may also have a sealing device. The sealing device allows incoming air to flow through the air openings 26 and into the pipe 12 while preventing the fire extinguishing fluid, such as a clean agent gas or liquid water, from flowing out of the pipe via the same opening 26.

An anti-flood device 30 is positioned between the sampling detector 22 and the water supply pipe 18 along the fire detection pipe 24. The anti-flood device 30 is adapted to allow gases, such as air for example, to flow from the water distribution pipe 18 towards the sampling detector 22 and prevent liquids, such as water for example, from propagating from the water distribution pipe 18 to the sampling detector 22. A suction device 32 is also fluidly connected to the fire detection pipe 24 via the sampling detector 22. The suction device 32 is adapted to draw air from the outside of the system 10 towards the sampling detector 22 via the air sampling openings 26, the water distribution pipe 12, the water supply pipe 18, and the fire detection pipe 24.

In one embodiment, the fire sprinkler system 10 has two operational modes, i.e. a fire detection mode and a fire extinguishing mode. When the fire sprinkler system 10 operates in the fire detection mode, the sprinkler system valve 20 is closed so that no water flows from the pressurized water source 16 into the water supply pipe 18. In this mode, the suction device 22 operates to draw air from the outside of the fire sprinkler system 10 towards the sampling detector 22 via the openings 26, as illustrated by arrows 34-46. The sampling detector 22 analyzes the drawn air to detect components indicative of a potential fire, such as smoke for example. Upon detection of the presence of components indicative of a potential fire, the system 10 switches to the fire extinguishing mode. Then, the sampling detector 22 sends a signal to the fire sprinkler valve 20 which opens, thereby allowing water to flow from the source 16 into the water supply pipe 18, as illustrated by arrow 50. Part of the water flowing into the water supply pipe 18 propagates into the fire detection pipe 24, as illustrated by arrow 52, but is prevented from reaching the sampling detector 22 by the anti-flood device 30. Water flows into the water supply pipe 18 and the water distribution pipe 12 as illustrated by arrows 54-58 in direction of the fire sprinklers 14. The waterproof devices 28 prevent the water flowing into the water distribution pipe 12 from exiting the pipe 12 through the air sampling openings 26. In some embodiments, the air openings 26 are spaced-apart on the pipe from the fire sprinklers 14. Stated differently, the air openings 26 are separate from the fire sprinklers 14. Since the waterproof devices 28 and the automatic sprinklers 14 substantially hermetically seal off the water distribution pipe 12, the opening of the valve 20 fills the water distribution pipe 12 with pressurized water. The fire sprinkler system 10 then corresponds to a wet pipe system. Upon detection of a fire by a sprinkler 14, the sprinkler 14 opens and water is discharged therethrough, as illustrated by arrows 60. Because the waterproof devices 28 prevent any water leakage via the air sampling openings 26, water damages are substantially prevented in areas where no fire has been detected and the pressurized water contained in the pipe 12 is preserved for discharge by the sprinklers 14 to combat fire.

In one embodiment, the sampling detector 22 is adapted to measure the quantity or concentration of components indicative of a potential fire present within the air reaching the sampling detector 22. In this case, the sampling detector 22 may be adapted to send the signal for opening the fire sprinkler valve 20 only when the measured quantity or concentration of components indicative of a potential fire is superior to a predetermined threshold.

In comparison to dry fire sprinkler system in which pipes are filled with a pressurized gas, the fire sprinkler system 10 allows water to reach the fire sprinklers 14 in lesser time since no pressurized gas is evacuated from the pipes.

In one embodiment, the sampling detector 22 and the suction device 32 continuously operate so that air samples are continuously drawn up to the sampling detector 22 and analyzed therein. In another embodiment, the sampling detector 22 and the suction device 32 operate discontinuously so that air samples are drawn and analyzed at different intervals in time. For example, an air sample may be drawn up to the sampling device 22 to be analyzed every 30 seconds, 2 minutes, 5 minutes, or the like.

In one embodiment, a solenoid valve is operatively connected to the sprinkler system valve 20. In this case, the sampling detector 22 or the control unit, if any, is in communication with the solenoid valve. Upon reception of a signal indicative of a potential fire, the solenoid valve releases the sprinkler system valve 20 in order to fill the water distribution pipe 12 with water.

In one embodiment in which the system 10 comprises a control unit, the fire sprinkler system 10 further comprises a flow meter adapted to measure the flow rate of the air reaching the sampling detector 22. The flow meter is in communication with the control unit and may be positioned between the anti-flood device 30 and the sampling detector 22, for example. The control unit monitors the measured flow rate value in order to detect any obstruction by ice for example or breakage in the fire sprinkler system 10. The flow rate of the air reaching the sampling detector 22 depends on the drawing force generated by the drawing device 32. Therefore, for a particular drawing force, a given flow rate of air should be measured by the flow meter. The control unit is adapted to compare the measured flow rate received from the flow meter to the given flow rate value. If the measured flow rate value is less than the given flow rate value, the control unit determines that at least one of the pipes 12, 18, and 24 is obstructed and outputs an alarm signal.

If the measured flow rate value is greater than the given flow rate value, the control unit may determine that a breakage occurs in the fire sprinkler system or at least one fire sprinkler 14 is opened, depending on whether the air sampling detector 22 detects the presence of components indicative of a potential fire within the analyzed air. If the air sampling detector 22 detects no components indicative of a potential fire within the analyzed air, the control unit interprets the increase of flow rate as a breakage in the fire sprinkler system 10. In this case, the control unit outputs an alarm signal indicative of a breakage. For example, a fire sprinkler 14 and/or at least one of the pipes 12, 18, and 24 may be broken so that air enters the system 10 thereby.

If the air sampling detector 22 detects components indicative of a potential fire within the analyzed air, the control unit interprets the increase of flow rate as an opening of at least one fire sprinkler 14 due to a potential fire. In this case, the system 10 may operate as a double interlock preaction system in which the sprinkler system valve 20 only opens when the control unit has determined that at least one fire sprinkler 14 is opened and the air sampling detector 22 has determined the presence of components indicative of a potential fire within the analyzed air Any adequate waterproof device 28 and anti-flood device 30 allowing air to pass therethrough while preventing water to pass therethrough may be used. In one embodiment, the waterproof device 28 and/or anti-flood device 30 comprises a waterproof membrane, such as a thermoplastic polyurethane membrane for example, adapted to allow air to pass therethrough while preventing any propagation of liquids such as water. In another embodiment, the waterproof device 28 and/or anti-flood device 30 comprises an air sampling valve controlled by the sampling detector 22 or the control unit, if any. In this case, when the system 10 operates in the fire detection mode, the air sampling valves are opened so that air samples may flow into the system 10 up to the sampling detector 22. Upon detection of elements indicative of a potential fire by the sampling detector 22, the sampling detector 22 or the control unit closes the air sampling valves so that no water may be discharged through the air sampling valves and no water may penetrate into the sampling detector 22.

While in the system 10 the air sampling detector 22 is a detector adapted to detect and/or measure elements indicative of a potential fire within the analyzed air, such as a smoke detector for example, it should be understood that the air sampling detector 22 may be any adequate detector adapted to determine a potential fire from the analyzed air. For example, the air sampling detector 22 can be adapted to determine a potential fire from the flow rate of the air reaching the detector 22. In this case, the air sampling detector 22 comprises a flow meter adapted to measure the flow rate of the air reaching the detector 22. Since the flow rate of the air reaching the air sampling detector 22 depends on the drawing force generated by the drawing device 32. Therefore, for a particular drawing force, a given flow rate of air should be measured by the flow meter. The air sampling detector 22 is adapted to compare the measured flow rate received from the flow meter to the given flow rate value. If the difference between the measured flow rate value and the given flow rate value is greater than a predetermined value, the air sampling detector 22 determines that the increase of the measured flow rate is due to the opening of at least one fire sprinkler 14. In this case, the air sampling detector 22 sends a signal to the sprinkler system valve 20 which opens.

While the present description refers to a pre-action fire sprinkler system 10 comprising two air sampling openings 26 and two fire automatic sprinklers 14, it should be understood that the system 10 may comprise any adequate number of openings and fire sprinklers as long as it comprises at least one automatic fire sprinkler 14 and at least one opening 26. For example, the number of openings 26 may be greater than the number of sprinklers 14. In another embodiment, the number of openings 26 may be less or equal to that of sprinklers 14.

Figure 2:
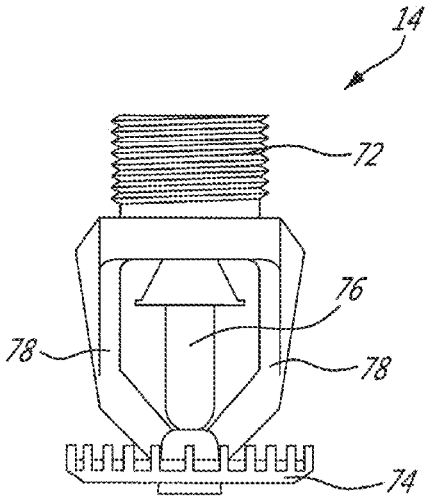
FIG. 2 is a side elevation showing an automatic fire sprinkler for use in accordance with the sprinkler system of FIG. 1.

FIG. 2 illustrates one embodiment of an automatic fire sprinkler 14. The automatic sprinkler 70 comprises a nozzle head 72, a deflector plate 74, and a heat-sensitive closure device 76. A deflector support 78 fixedly secures the deflector plate 74 to the nozzle head 72 at a predetermined distance apart. The deflector plate 74 is adapted to produce a specific spray pattern designed in support of the goals of the sprinkler type, i.e. control or suppression of the fire. The heat-sensitive closure device 76 substantially hermetically seals off the nozzle head 72 so that no water may be discharged therethrough. The heat-sensitive closure device 76 is adapted to seal the nozzle head 72 up to a predetermined temperature. When the system 10 is in the fire extinguishing mode, i.e. when pressurized water is contained in the pipe 12, and when the temperature around the automatic fire sprinkler 14 reaches the predetermined temperature, the heat-sensitive closure device 76 disintegrates and water is discharged through the automatic fire sprinkler 14.

The heat-sensitive closure device 76 may be any adequate device adapted to substantially hermetically seal the nozzle head 72 of the automatic fire sprinkler 14 up to a predetermined temperature. For example, the heat-sensitive closure device 76 may be adapted disintegrate or eject from the nozzle head 72 when its temperature reaches the predetermined temperature. A liquid-filled glass vessel and a fusible soldered link are examples of adequate heat-sensitive closure device 76.

Figure 3:
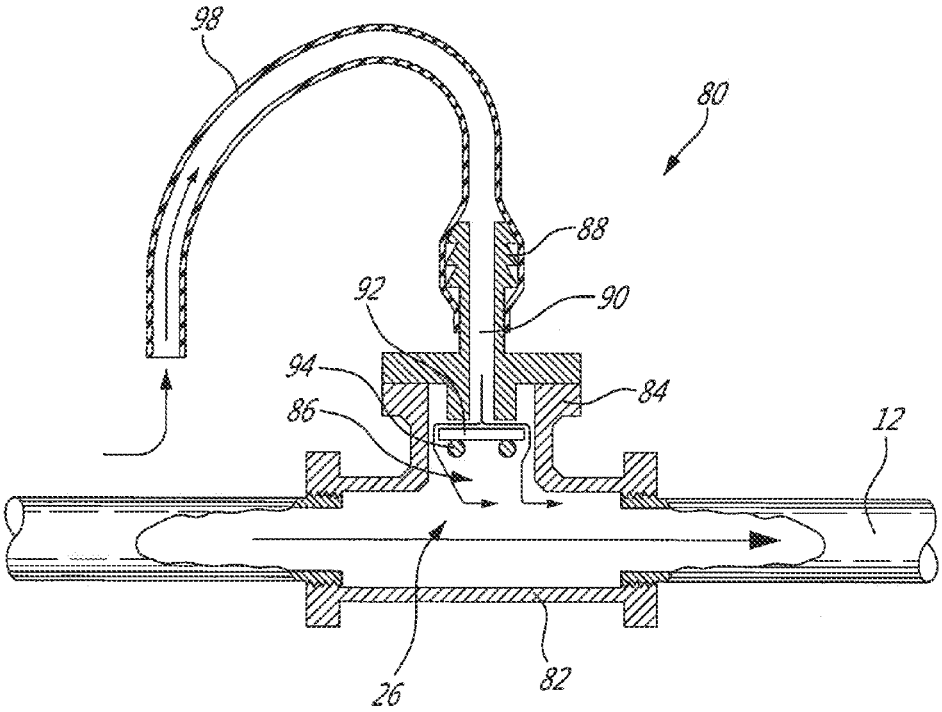
FIG. 3 is a partially sectioned view of a waterproof device of the sprinkler system of FIG. 1, shown in an open position.

FIG. 3 illustrates one embodiment of a waterproof device 80 adapted to allow air entering into the system 10. The waterproof device 80 comprises a securing portion 82 and a main portion 84. The securing portion 82 is shaped and sized to substantially hermetically secure the waterproof device 80 to the water distribution pipe 12. For example, the securing portion 82 may have a tubular shape having an internal diameter substantially equal to the outer diameter of the pipe 12. The waterproof device 80 is positioned on the pipe so that the main portion 84 is on top of the pipe 12.

The main portion 84 comprises an internal cavity 86 which faces the air sampling opening 26 of the water distribution pipe 12 so that fluids may flow from the water distribution pipe 12 into the cavity 86 and vice versa. The main portion 84 comprises a tubular section 88 defining a channel 90 which fluidly connects the cavity 86 to the outside of the fire sprinkler system 10.

A valve assembly is located within the chamber. The valve assembly comprises a channel closing device 92 made of a buoyant material and a support 94. The surface of the tubular section 88 facing the channel closing device 92 corresponds to a valve seat. When the fire sprinkler system 10 operates in the fire detection mode, the water distribution pipe 12 contains no water. Because the main portion 84 is on top of the pipe 12, the channel closing device 92 seats on the support 84 due to the gravitational force. The channel closing device 92 is shaped and sized to move between the support 94 and the top wall of the internal cavity 86. When the channel closing device 92 seats on the support 94, the channel 90 is opened so that air may flow from the outside of the fire sprinkler system 10 into the cavity 86 via the channel 90. The air then flows between the channel closing device 92 and the side walls of the cavity 86 to reach the water distribution pipe 12 and subsequently the sampling detector 22.

Figure 4:
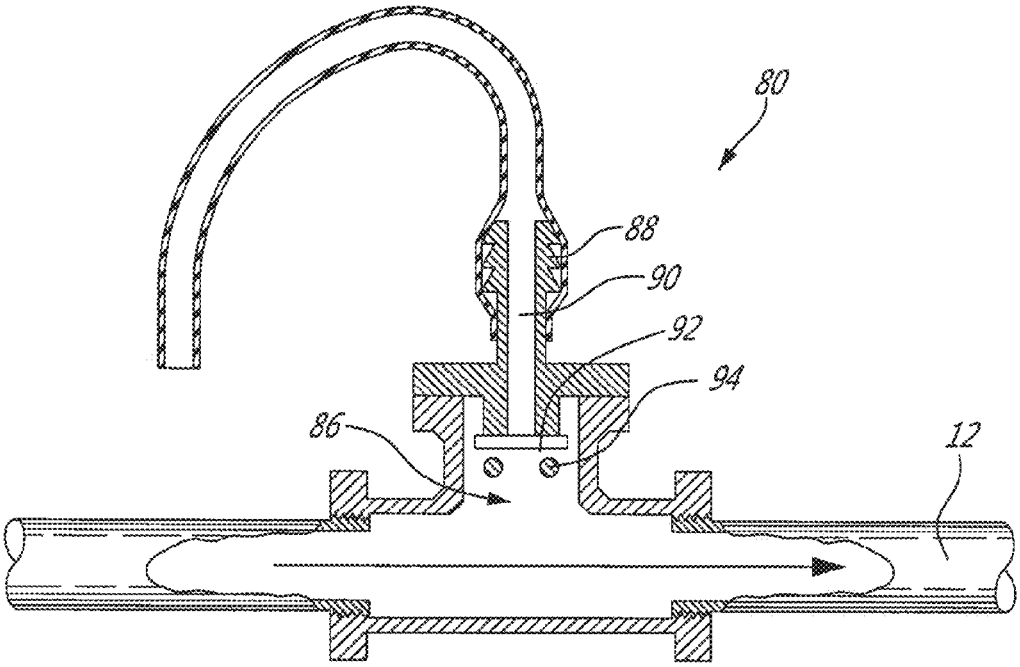
FIG. 4 is a partially sectioned view of the waterproof device of FIG. 3, shown in a closed position.

FIG. 4 illustrates the waterproof device 80 when the system 10 operates in the fire extinguishing mode. In this mode, pressurized water flows into the water distribution pipe 12 and enters into the cavity 86 via the air sampling opening 26. When the pressurized water enters into the cavity 86, the channel closing device 92 is raised by the water which exerts an upward force thereon until abutting against the valve seat, i.e. the surface of the tubular section 88. As the water pressure increases, the channel closing device 92 substantially hermetically seals the channel 90 due to the pressure differential between the pressurized water and the atmospheric air outside the system 10. As a result, no discharge of water occurs via the channel 90. When the water contained in the pipe 12 has been drained out of the system 10 or discharged via the automatic sprinklers 14, the channel closing device 92 returns to its stand-by position, i.e. seats on the support 94.

In one embodiment, the waterproof device 80 comprises no tubular section 88 which is replaced by an opening in the top wall of the main portion 84. The channel closing device 92 is then adapted to abut against the surface surrounding the opening to substantially hermetically seal the opening.

While it is separate from the water distribution pipe 12, the waterproof device 80 illustrated in FIGS. 3 and 4 may be integral with the water distribution pipe 12. In this case, the waterproof device 80 comprises no securing portion 82 and the main portion 84 is integral with the pipe 12.

In one embodiment, the waterproof device 80 further comprises a sampling tube 98 having one end fluidly connected to the tubular section 88. The other end of the sampling tube 98 is positioned at an adequate location for drawing air samples. For example, when the pipe 12 is located in a ceiling, the other end of the sampling tube 98 may extend from the ceiling in order to draw air contained within a room below the ceiling.

Figure 5:
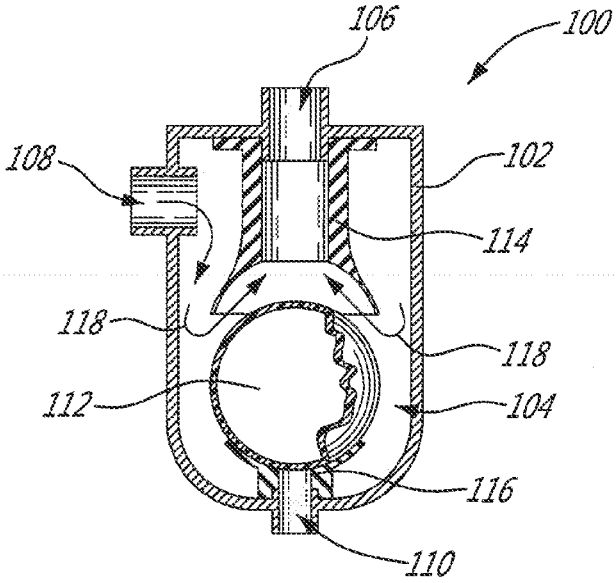
FIG. 5 is a cross-sectional view of an anti-flood device for use in the sprinkler system of FIG. 1, shown in an open position.

FIG. 5 illustrates one embodiment of anti-flood device 100 which may be positioned along the air sampling pipe 24 between the water supply pipe 18 and the sampling detector 22 in order to allow air to reach the sampling detector 22 and prevent water to pass therethrough. The anti-flood device 100 comprises a body 102 having a substantially elongated shape. The body 102 is provided with an internal cavity 104 and three openings 106, 108, and 110. The sampling detector 22 is fluidly connected to the cavity 104 via the opening 106. The opening 108 fluidly connects the cavity 14 to the air sampling pipe 24 and the opening 110 is used to fluidly connect the cavity 104 to an evacuation drain.

A buoyant element 112 is located within the internal cavity 104. A receiving hollow portion 114 and a seating hollow portion 116 are positioned around the openings 106 and 110, respectively, inside the internal cavity 104. The portions 114 and 116 each comprise a conduit extending therethrough and fluidly connected to the openings 106 and 110, respectively.

A first end of receiving hollow portion 114 is substantially hermetically secured to the internal surface of the body 102 around the opening 106 so that no fluid may leak between the receiving hollow portion 114 and the body 102. The second end of the receiving hollow portion 114 has a shape that matches that of the buoyant element 112 so that the receiving hollow portion 114 is substantially hermetically sealed when the buoyant element 112 abuts against the second end of the receiving hollow portion 114.

A first end of the seating hollow portion 116 is substantially hermetically secured to the internal surface of the body 102 around the opening 110 so that no fluid may leak between the seating hollow portion 116 and the body 102. The second end of the seating hollow portion 116 has a shape that matches that of the buoyant element 112 so that the seating hollow portion 116 is substantially hermetically sealed when the buoyant element 112 seats on the second end of the seating hollow portion 116.

When the anti-flood device 100 is integrated into the system 10, the openings 106, 108 and 110 are fluidly connected to the sampling detector 22, the air sampling pipe 24, and the evacuation drain, respectively. The anti-flood device 100 is positioned so that the opening 106 is on top of the opening 110. When the system 10 operates in the detection mode, the buoyant element 112 is biased in an open position, i.e. it seats on the second end of the seating hollow portion 116 because of the gravitational force. The evacuation drain connected to the opening 110 is then substantially hermetically sealed so that substantially no fluid may flow from the cavity 104 into the evacuation drain, and the receiving hollow portion 114 is open so that air may flow from the air sampling pipe 24 up to the sampling detector 22. The air drawn by the suction device 32 enters the cavity 104 via the opening 108, flows between the buoyant element 112 and the receiving hollow portion device 114, and exits the cavity 104 via the opening 106, as illustrated by arrows 118.

When the system 10 operates in the fire extinguishing mode, water propagates in the air sampling pipe 24 and enters the cavity 104 via the opening 108. The surface area of the opening 110 is less than that of the opening 108 so that the quantity of water entering the cavity 104 via the opening 108 is greater than the quantity of water that exits the cavity 104 via the opening 110. As the level of water rises within the cavity 104, the buoyant element 104 is lifted from the seating hollow portion 116 and abuts against the second end of the receiving hollow portion 114, thereby reaching a closed position. When in the closed position, the buoyant element 104 substantially hermetically seals the receiving hollow portion 114, thereby preventing water to reach the sampling detector 22.

In one embodiment, the anti-flood device 100 comprises no opening 110 connected to the evacuation drain. In this case, the anti-flood device 100 may also comprise no seating hollow portion 116.

In one embodiment, the evacuation drain connected to the opening 110 is provided with a sensor adapted to detect a flow of fluid such as a water pressure switch for example. When water flows into the evacuation drain connected to the opening 110, the sensor detects the flow of water and outputs a signal indicative that water is flowing into the anti-flood device 100, and therefore into the sprinkler system 10. Alternatively, the position of the buoyant device 112 within the anti-flood device 100 may be used to determine whether water is flowing into the anti-flood device 100. Any adequate position sensor adapted to determine the position of the buoyant device 112 inside the anti-flood device 100 may be used. Alternatively, the receiving hollow portion 114 may be provided with a sensor, such as a mechanical or optical sensor for example, adapted to determine whether the buoyant device 114 abuts thereagainst and trigger a signal indicative that water if flowing into the anti-flood device 100.

Figure 7A:
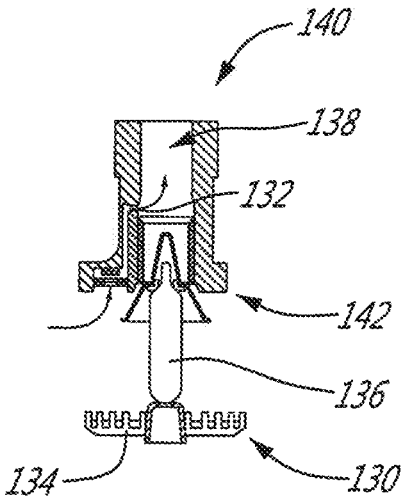
FIGS. 7*a*-7*c* illustrate an air sampling fire sprinkler for use in a sprinkler system, in accordance with a first embodiment.
Figure 7B:
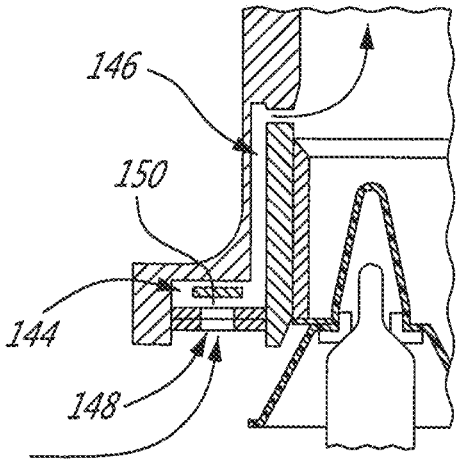
Figure 7C:
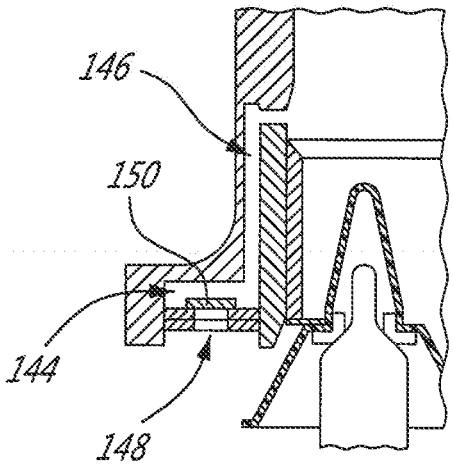
Figure 8:
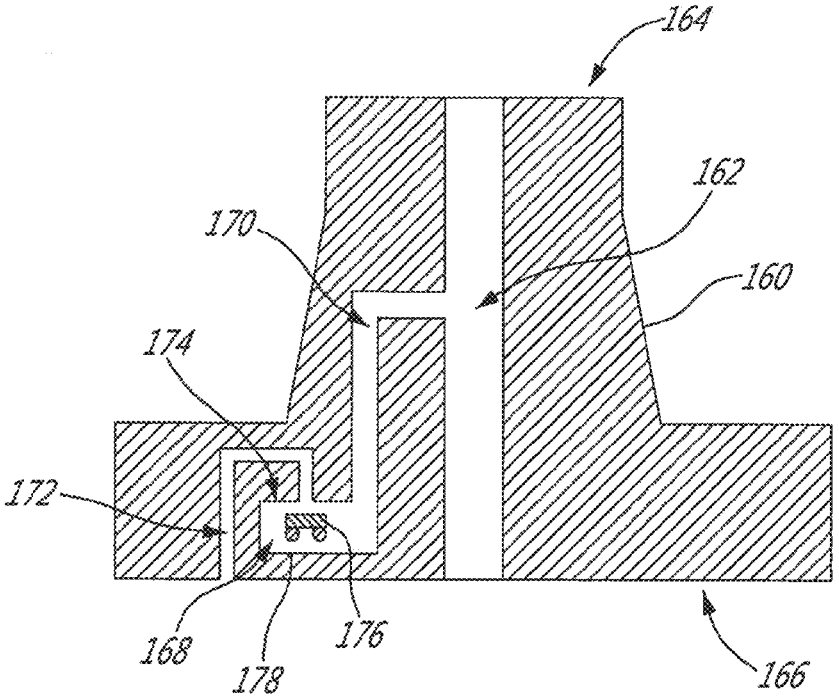

FIGS. 7*a*-7*c* illustrate one embodiment of an air sampling sprinkler 130 adapted to discharge water and draw air samples for smoke detection. The sprinkler 130 comprises a nozzle head 132, a deflector plate 134, and a heat-sensitive closure device 136. A support (not shown) fixedly secures the deflector plate 134 to the nozzle head 132 at a predetermined distance apart. A conduit 138 extends through the nozzle head 132 from a water entering end 140 to a water discharging end 142 which faces the deflector plate 134. The heat-sensitive closure device 136 substantially hermetically seals off the opening 138 at the water discharging end 142. The heat-sensitive closure device 136 is adapted to eject from the nozzle head 132 or disintegrate at a predetermined temperature, thereby allowing a discharge of water via the conduit 138 of the nozzle head 132.

A cavity 144 is located within a wall of the nozzle head 132. The cavity 144 is fluidly connected to the conduit 138 via a channel 146. An opening 148 in the water discharging end 142 of the nozzle head 132 fluidly connects the cavity 144 to the outside of the sprinkler 130 so that air may flow from the region surrounding the water discharging end 142 to the cavity 144, and up to the conduit 138 of the nozzle head 132 via the channel 146. A closure device 150 is located inside the cavity 144 and has a shape and size adapted to substantially hermetically seal the opening 148. The closure device 150 is biased in an open position by a biasing element (not shown) such as a spring for example. In the open position, the closure device 150 is spaced apart from the opening 148 so that air may flow from the surrounding of the water discharging end 142 into the cavity 144. The closure device 150 and the biasing element form a water proof device allowing air to be drawn from the outside of the sprinkler 130 via the opening 148 up to the conduit 138 and preventing water from exiting the nozzle head 132 via the opening 148.

FIG. 7*c* illustrates the sprinkler 130 when the closure device 150 is in a closed position. When pressurized water flows into the conduit 138 of the nozzle head 132 from the incoming water end 140 to the water discharging end 142, part of the water flows into the cavity 144 via the channel 146. The pressurized water entering the cavity 144 exerts a pressure on the closure device 150 which moves downwards and substantially seals the opening 148. It should be understood that the biasing force of the biasing element (not shown) is chosen to be greater than the gravitational force so that the closure device 150 is in the open position when no water flows in the cavity 144. The biasing force is also chosen to be less than the force exerted by the pressurized water onto the closure device 150 so the pressurized water entering the cavity 144 may bring the closure device 150 into the closed position.

When it is used in the sprinkler system 10, the air sampling sprinkler 130 is fluidly connected to the water distribution pipe 12 via the air sampling opening 26 and the system 10 comprises no water proof device 28 which is replaced by the water proof device formed by the assembly of the closure element 150 and the biasing element.

Figure 8:
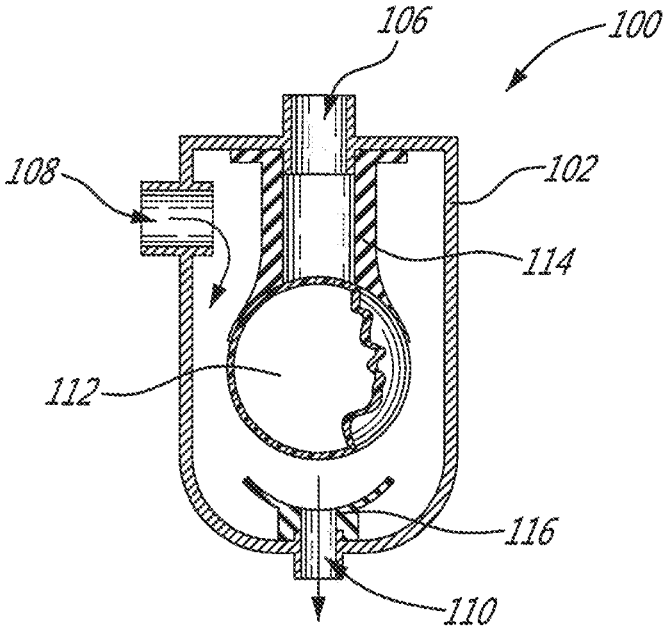
FIG. 8 illustrates a nozzle head of an air sampling fire sprinkler in accordance with another embodiment, the nozzle head being shown in an open position.

FIG. 8 illustrates one embodiment of a nozzle head 160 for an automatic fire sprinkler. The nozzle head 160 comprises a conduit 162 extending from a water entering end 164 to a water discharging end 166. The water entering end 164 of the head nozzle 160 is adapted to be secured to the water distribution pipe 12 so that water and air may flow from the water distribution pipe 12 into the conduit 162 and vice versa. A heat-sensitive closure device (not shown) substantially hermetically seals the conduit 162 at the water discharging end 166. A deflector plate (not shown) is fixedly secured to the water discharging end 166 at a predetermined distance apart by any adequate securing device such as a pair of brackets for example.

The nozzle head 160 comprises a cavity 168 fluidly having a first opening fluidly connected to the conduit 162 via a channel 170. The cavity 168 comprises a second opening fluidly connected to the water discharging end 166 via a channel 172. The channel 172 has a first end located on the water discharging end 166 and a second end located on a top wall 174 of the cavity 168 which faces the water entering end 164 of the nozzle head 160. The nozzle head 160 further comprises a buoyant element 176 having a shape and size adapted to substantially hermetically seal the second opening of the cavity 168 in order to seal the channel 172.

When it is used in the sprinkler system 10, the air sampling sprinkler comprising the nozzle head 160 is fluidly connected to the water distribution pipe 12 via the air sampling opening 26 and the system 10 comprises no water proof device 28. The water entering end 164 of the nozzle head 160 is secured to the water distribution pipe 12 so that the water entering end 164 be on top of the water discharging end 166. Due to the gravitational force, the buoyant device 176 seats on a support 178 at a predetermined distance from the end 174 of the channel 172.

Figure 9:
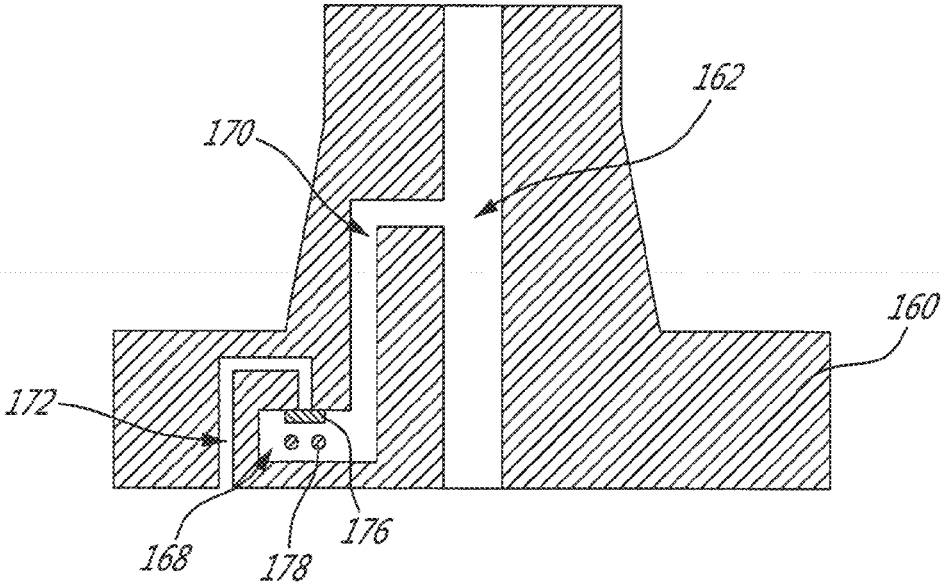
FIG. 9 illustrates the nozzle head of FIG. 8, shown in a closed position.

When the sprinkler system 10 operates in the fire detection mode, the buoyant device 176 is in an open position, i.e. it seats on the support 178, and the channel 172 is open so that air may be drawn from the outside of the nozzle head 160 into the conduit 162 via the channels 170 and 172. When the sprinkler system operates in the fire extinguishing mode, pressurized water flows into the conduit 162. Part of the water flowing in the conduit 162 propagates in the channel 170 up to the cavity 168. As the water level rises into the cavity 168, the buoyant device 176 is raised from its open position up to a closed position in which it abuts against the top wall 174 of the cavity 168 and substantially hermetically seals the channel 172, thereby preventing the water from propagating into the channel 172, as illustrated in FIG. 9.

In one embodiment, the nozzle head 160 comprises no support 178. In this case, the buoyant device 176 seats on the bottom wall of the cavity 168 when in the open position.

In one embodiment, the waterproof device 80, the anti-flood device 100, the nozzle head 132, and/or the nozzle head 160 are provided with a guiding structure for guiding the buoyant device 92, the buoyant device 112, the closure element 150, and/or the buoyant device 176, respectively, between the open and closed positions.

The buoyant device 92, the buoyant device 112, the closure element 150, and the buoyant device 176 may have any adequate shape and size adapted to substantially hermetically seal the channel 90, the openings 106 and 110, the opening 148, and the channel 172, respectively.

Figure 10:
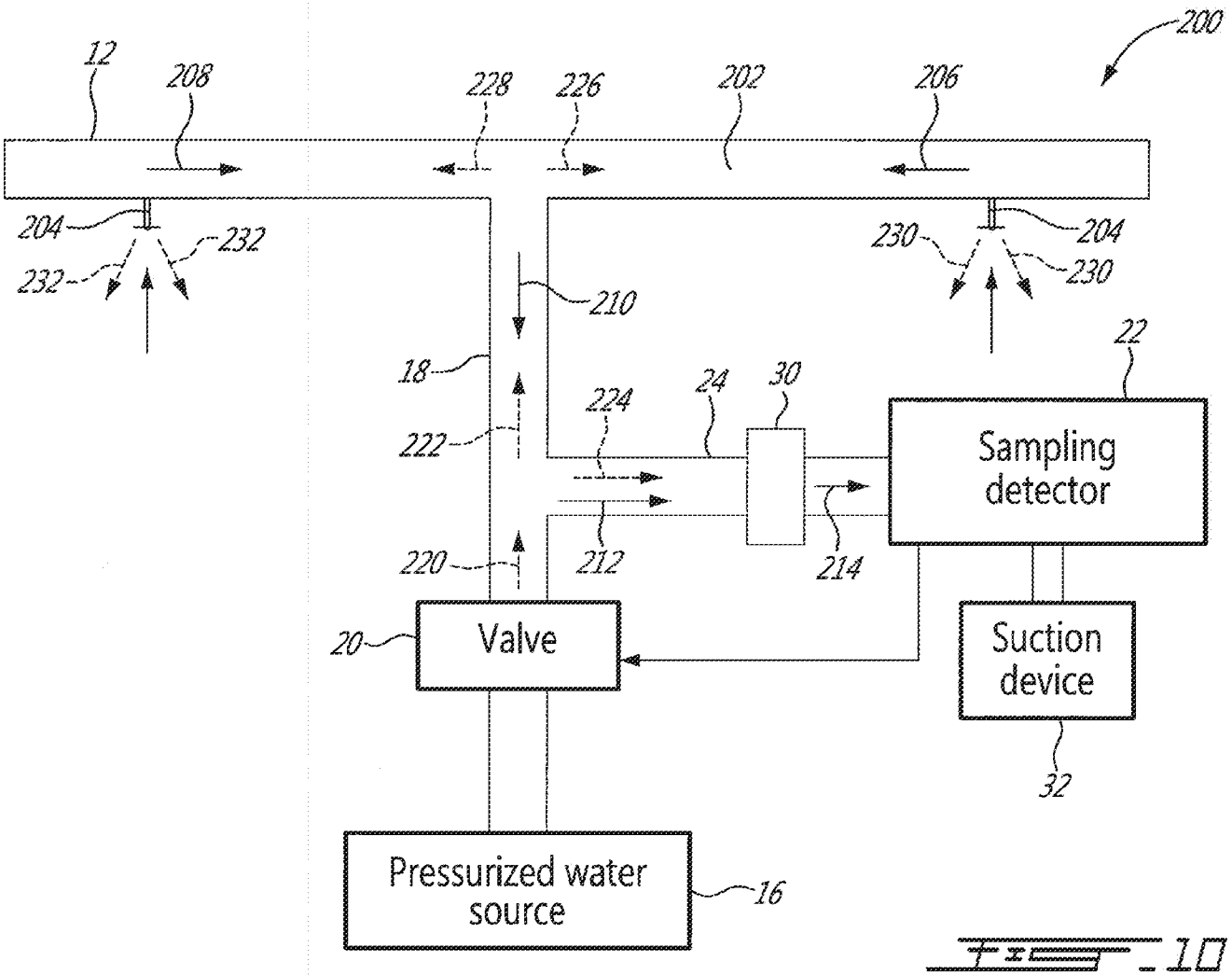
FIG. 10 is a schematic diagram illustrating a pre-action deluge sprinkler system, in accordance with another embodiment of the present disclosure.

FIG. 10 illustrates one embodiment of a deluge fire sprinkler system 200 comprising at least one water distribution pipe 202 connected to a water supply pipe 18, a valve 20, a sampling detector 22, and a suction device 32. The water supply pipe 18 is connected to a source of pressurized water 16 via the valve 20. The suction device 32 is fluidly connected to the sampling detector 22 which is fluidly connected to the water supply pipe 18 via a pipe 24 and an anti-flood device 30. The system 200 comprises at least one open sprinkler 204 fluidly connected to the water distribution pipe 202. The open sprinklers 204 correspond to a sprinkler provided with no heat-sensitive closure system hermetically sealing the nozzle head of the sprinkler. As a result, water and air may freely pass through the open sprinklers 204. In another embodiment, each sprinkler 204 is provided with a releasable cap which non-hermetically closes the opening of the sprinkler 204 so that air may be drawn from the outside of the system 200 towards the sampling device 22 via the sprinkler 204. For example, the cap may comprise an orifice having a size adequate for the air sampling. Once the valve 20 is opened, water reaches the sprinklers 204 and exerts a force on the caps. The caps are ejected from their respective sprinkler 204 as a result of the force exerted by the water thereon, thereby allowing water to freely pass through the sprinklers 204.

When the system 200 operates in a fire detection mode, the suction device 32 is activated in order to draw air samples up to the sampling detector 22. Air surrounding the open sprinklers 204 is drawn by the suction device 32 up to the sampling detector 22 via the open sprinklers 204, the water distribution pipe 202, the water supply pipe 18, the air sampling pipe 24, and the anti-flood device 30, as illustrated by arrows 206-214.

Upon detection of elements indicative of a fire within the analyzed air, the sampling detector 22 sends a signal to the fire sprinkler system valve 20 which opens upon reception of the signal, thereby allowing water to flow in the water distribution pipe 18 as illustrated by arrows 220 and 222. The water entering the air sampling pipe 24 is blocked by the anti-flood device 30 so that no water reaches the sampling detector 22, as illustrated by arrow 224. The water then flows into the water distribution pipe 202, as illustrated by arrows 226 and 228, and is concurrently discharged by all of the open sprinklers 204, as illustrated by arrows 230 and 232.

It should be understood that any adequate suction device 32 adapted to draw air through the openings 26 up to the sampling detector 22 can be used. For example, the suction device 32 can be a pump that generates a lower pressure in the sampling detector 22 or in the vicinity thereof with respect the pressure outside of the sprinkler system 10. As a result of the pressure difference, air is drawn from the outside of the system 10 up to the sampling detector 22 via the openings 26. In another embodiment, the suction device can be a fan.

In one embodiment, the sampling detector 22 is a smoke detector adapted to detect the presence of smoke within an air sample. For example, the sampling detector 22 can be an ionization detector, a cloud chamber detector, a laser scattering detector, a particle counting detector, or the like.

Figure 11:
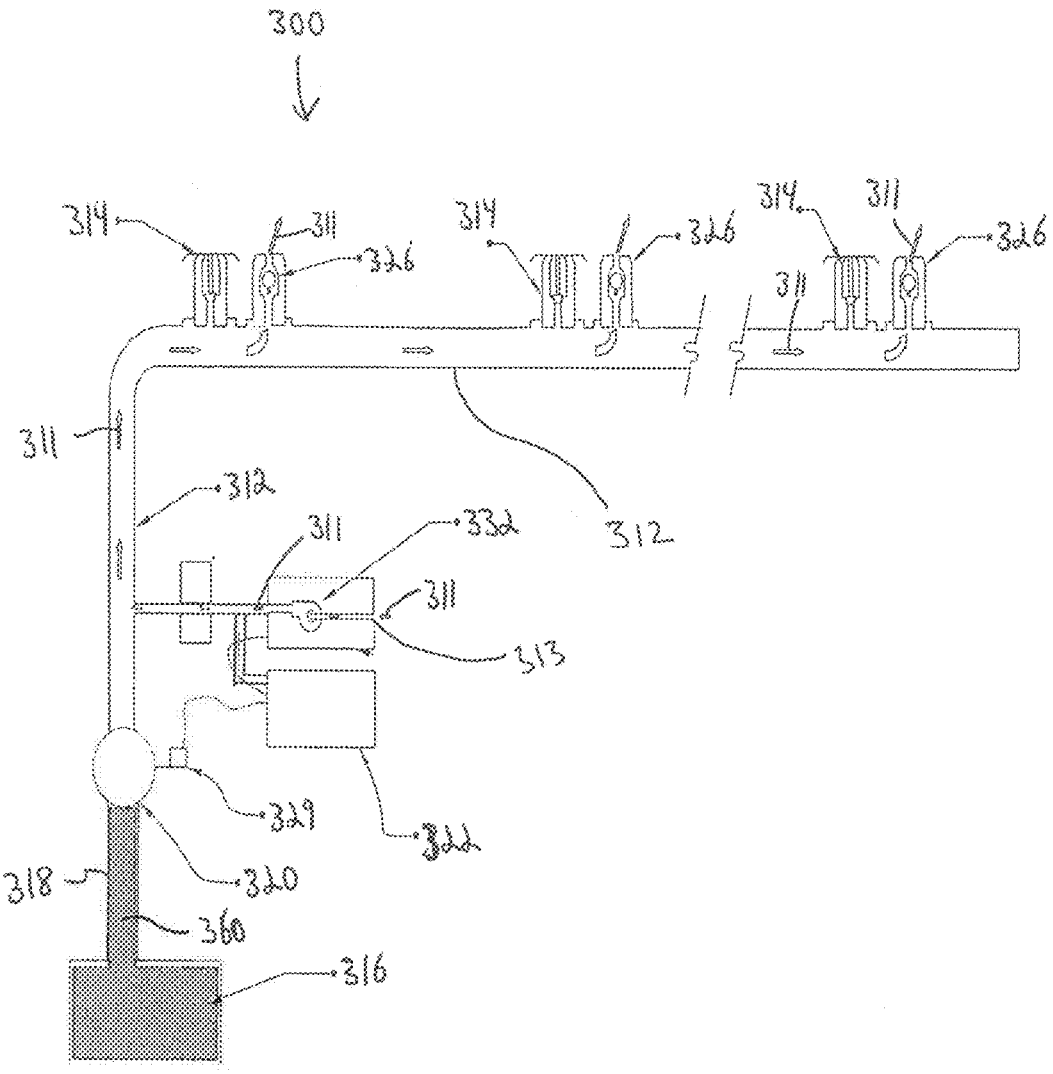
FIG. 11 is a schematic diagram illustrating a sprinkler system in accordance with yet another embodiment of the present disclosure, with ambient air shown being expelled from the sprinkler system.
Figure 12:
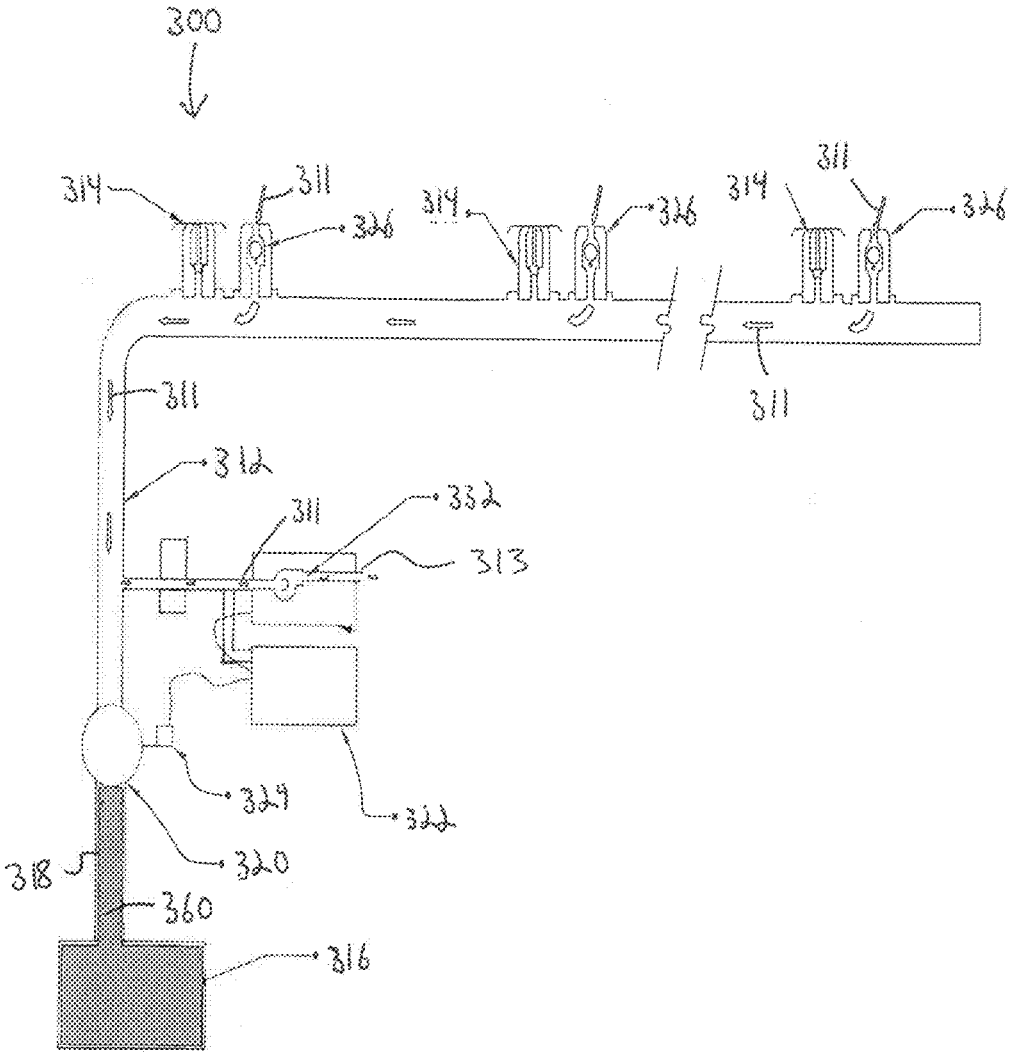
FIG. 12 is a schematic diagram of the sprinkler system of FIG. 11, with ambient air shown being drawn into the sprinkler system.

FIGS. 11 and 12 illustrate another embodiment of the fire sprinkler system 300. The system 300 includes a piping system having at least one dual-use pipe 312 providing both one or more air conveying inlets, and one or more fire extinguishing fluid conveying outlets for the system 300. The dual-use pipe 312 has at least one air opening 326 therein allowing ambient air 311 to flow into or out of the pipe 312, and at least one sprinkler 314 fluidly connected to the pipe 312 for ejecting the fire extinguishing fluid 360 (such as a clean agent in gas and/or liquid form, or water) from the pipe 312 in the event of detection of a fire condition by the system 300 in the manner which will be described in further detail below.

The system 300 also includes a pressurized source 316 of fire extinguishing fluid 360 which is fluidly connected to the pipe 312 via a supply pipe 318. A valve 320 controls the flow of pressurized extinguishing fluid 360 to be delivered from the supply pipe 318. The valve 320 may be activated by a solenoid 329 in electrical communication with a control unit 322.

The system 300 also includes a blower 332 that is also fluidly connected to the pipe 312. The blower 332 circulates a substantially continuous flow of ambient air 311 through the pipe 312. Ambient air 311 is both drawn into the pipe 312 from the surrounding air, and expelled from the pipe 312 to the surrounding air via the one or more air openings 326. For example, in the configuration shown in FIG. 11, the blower 332 draws ambient air 311 so that it has a unidirectional flow path. More particularly, the ambient air 311 is drawn into the pipe 312 via the blower 332 from its surroundings, for example at opening 313, is circulated through the pipe 312, and is expelled from the pipe 312 via the air openings 326. In the configuration shown in FIG. 12, the blower 332 creates suction, drawing ambient air 311 into the pipe 312 via the air openings 326, circulating it through the pipe 312, and expelling it from the pipe 312 through the opening 313. It can thus be appreciated that the blower 332 may also generate suction.

The system 300 also includes a control unit 322 in communication with the blower 332 and the valve 320 via the solenoid 329. The control unit 322 is adapted to open the valve 320 and flood the pipe 312 upon reception of a signal indicating detection of a potential fire.

In order to determine when this flooding of the pipe 312 should occur, the control unit 322 measures the flow of the ambient air 311 through the pipe 312 or through the blower 332. The control unit 322 may therefore be fluidly connected to the pipe 312 and/or to the blower 332, and may include a flow meter. The control unit 322 defines a baseline flow rate value and/or pressure of the ambient air 311. The baseline flow rate value represents the "normal" flow rate value of the ambient air 311 for steady state (i.e. no fire) conditions, and is a function of the particular suction or blowing force of the blower 332 to circulate air 311 through the pipe 312.

The control unit 322 compares the measured flow rate value it obtains to the baseline flow rate value at regular or irregular intervals. If the difference between the measured flow rate value and the baseline flow rate value is greater than a predetermined delta value, the control unit 322 determines that there may be a fire condition. When this occurs, the control unit 322 sends a signal to the solenoid 329 to open the valve 320, which then floods the pipe 312 with the fire extinguishing fluid. The flow of air 311 in the pipe 312 can be monitored by the control unit 322, which measures the flow rate through the use of, for example, an ultrasonic, or hot wire, or other type of flow meter, or determining flow rate using a proxy measurement such as pressure. The control unit 322 can also analyze the flow for any changes.

The difference between the measured flow rate value and the baseline flow rate value is typically expressed as an absolute value or magnitude, to reflect that the system 300 can operate both in suction and as a blower. In most embodiments, this difference exceeds the predetermined delta value when ambient air 311 is flowing into or out of one or more of the fire sprinklers 314.

During normal, no fire, operation, the fire sprinklers 314 are closed and the flow of ambient air 311 within the pipe 312 remains relatively constant. In the event of a fire, the temperature of the air 311 surrounding the fire sprinklers 314 will rise. At a predetermined temperature, a thermally-actuated fire sprinkler 314, discussed in greater detail below, will open. The opening of the fire sprinkler 314 will cause a detectable difference of flow in the pipe 312 from the baseline flow rate value. If the difference exceeds the predetermined delta value, the change of flow rate will be captured by the control unit 322. The control unit 322 interprets the difference in flow rate as an opening of at least one fire sprinkler 314 due to a potential fire. The control unit 322 may then display the fire condition, open the valve 320, and/or signal other devices such as building system fire alarms, outside monitoring systems, and equipment shut-down devices.

Figure 13:
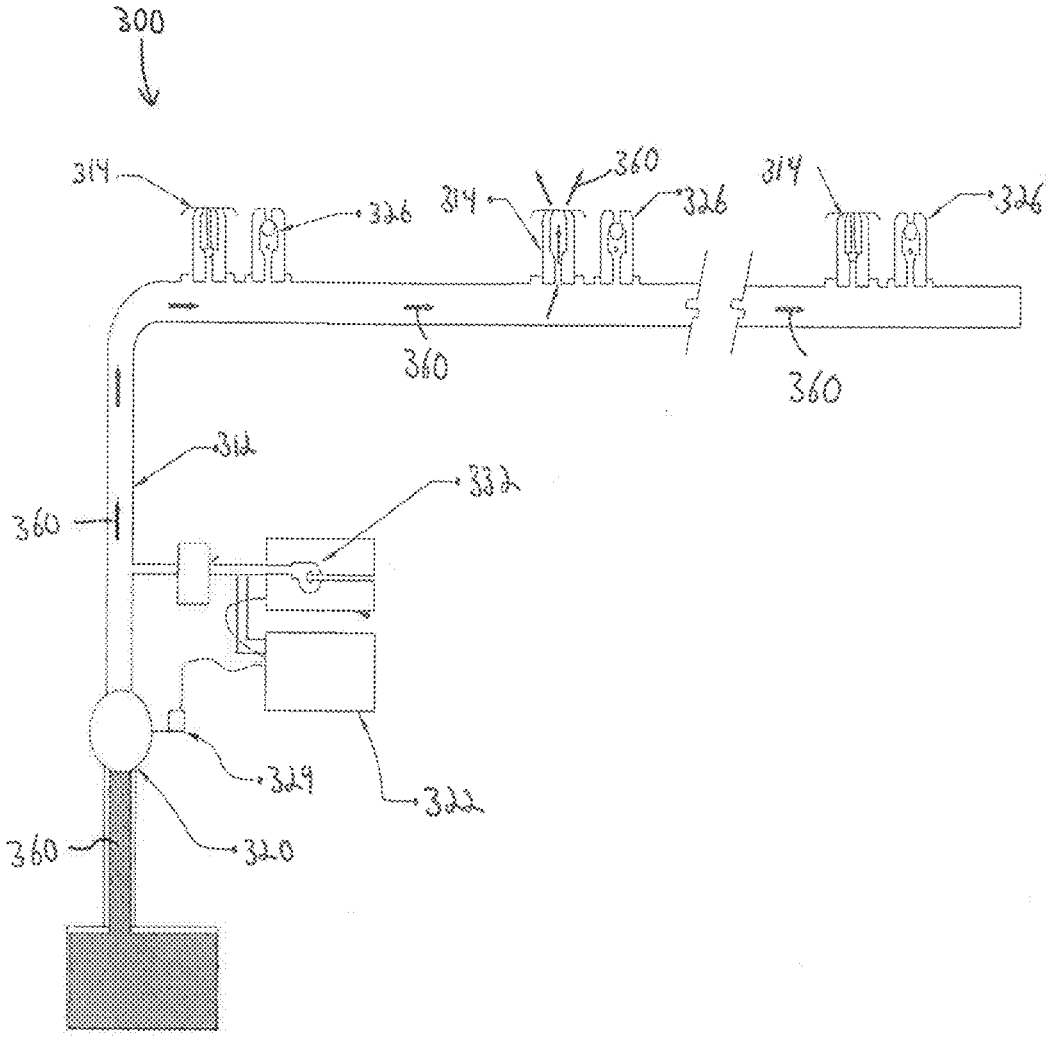
FIG. 13 is a schematic diagram of the sprinkler system of FIG. 11, with fire extinguishing fluid being shown filling the sprinkler system.

Referring to FIG. 13, upon detection of the fire condition based on a change in the measured flow rate, the control unit 322 will open the valve 320, allowing extinguishing fluid 360 to flow into the pipe 312, and to exit through any of the actuated (i.e. open) fire sprinklers 314. Additional fire sprinklers 314 will open as necessary to extinguish or control the fire. The extinguishing fluid 360 admitted to the pipe 312 is prevented from exiting through the air openings 326, as explained below. In this embodiment, the fire sprinklers 314 are automatic fire sprinklers 314.

The control unit 322 may employ different signal processing schemes or software algorithms to account for minor or transient shifts in the measured flow rate which are not indicative of a fire condition. These shifts might be due to factors other than an opening of the fire sprinklers 314, such as changes in local atmospheric pressure, changes in room pressure due to ventilation devices, and changes in the viscosity of air due to temperature change, etc.

Figure 14A:
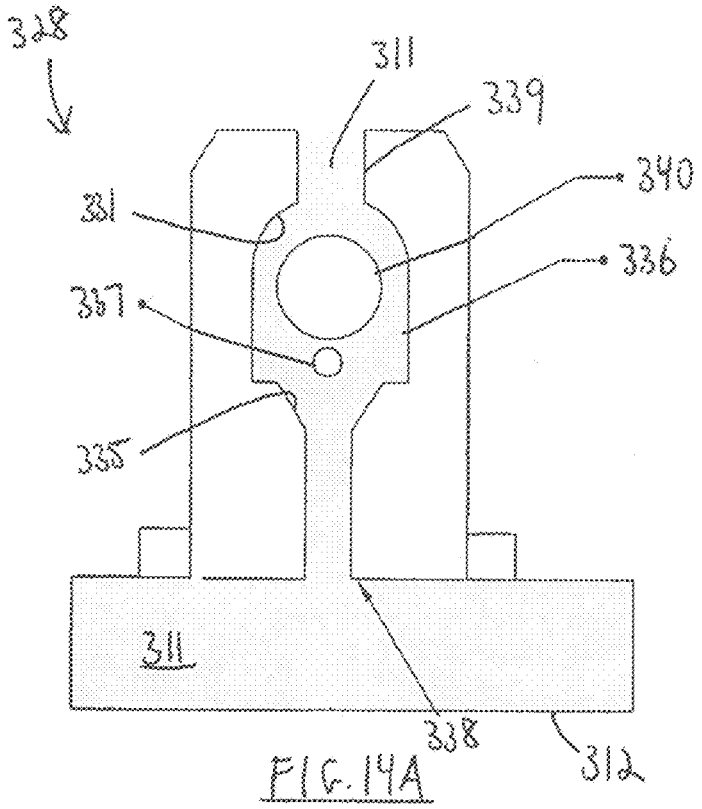
FIGS. 14A and 14B are cross-sectional views of a selective flow valve for use with a fire sprinkler system.
Figure 14B:
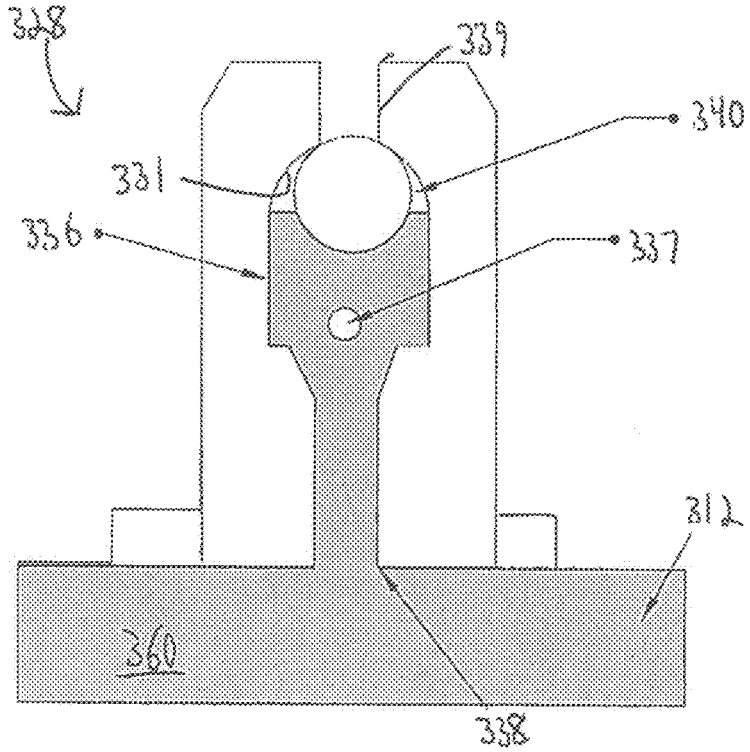

Referring to FIGS. 14A and 14B, each of the air openings 326 may have a selective flow valve 328. Each selective flow valve 328 is mounted in sealed engagement with a corresponding air opening 326. When in use, each selective flow valve 328 conveys ambient air 311 either into or out of the pipe 312 during steady state conditions, and prevents the fire extinguishing fluid from exiting the pipe 312 via the associated air opening 326 when a fire condition is detected. In the embodiment of FIGS. 14A and 14B, the selective flow valve 328 has an internal cavity 336. The cavity 336 extends between a second fluid passage 338 in fluid connection with the pipe 312 to allow fluid (air or fire extinguishing fluid) to enter or exit the cavity 336 near the pipe 312, and a first fluid passage 339 through which fluid is conveyed into or out of the cavity 336. In the configuration where the selective flow valve 328 is oriented vertically with respect to the pipe 312, the cavity 336 defines an upper surface 331 adjacent to the first fluid passage 339, and a lower surface 335 in proximity to the second fluid passage 338.

The selective flow valve 328 also has a fixed retainer 337 and a buoyant element 340. The retainer 337 is fixed within the cavity 336 and obstructs, or limits, the movement of the buoyant element 340 such that it is prevented from obstructing the second fluid passage 338. The buoyant element 340 can be a ball or other object which floats on the liquid fire extinguishing fluid.

When the system 300 is in steady state operation (i.e. no fire), as shown in FIG. 14A, ambient air 311 enters the cavity 336 from the surrounding environment via the first fluid passage 339 if the blower is sucking air 311 into the pipe 312 via the air openings 326, or via the second fluid passage 338 and the pipe 312 if the blower is expelling air 311 via the air openings 326. The air 311 circulating within the cavity 336 will displace the buoyant element 340, and the retainer 337 will prevent the buoyant element 340 from abutting against the lower surface 335, and thus will prevent the second fluid passage 338 from becoming blocked/sealed.

When the system 300 has detected the fire condition, as shown in FIG. 14B, the extinguishing fluid 360 (water, for example) will enter the cavity 336 via the second fluid passage 338 from the pipe 312. When the cavity 336 is filled with the fire extinguishing fluid, the fire extinguishing fluid 360 will force the buoyant element 340 to abut against the correspondingly shaped upper surface 331, thereby sealing off the first fluid passage 339 and preventing the fire extinguishing fluid from exiting the selective flow valve 328.

Figure 15A:
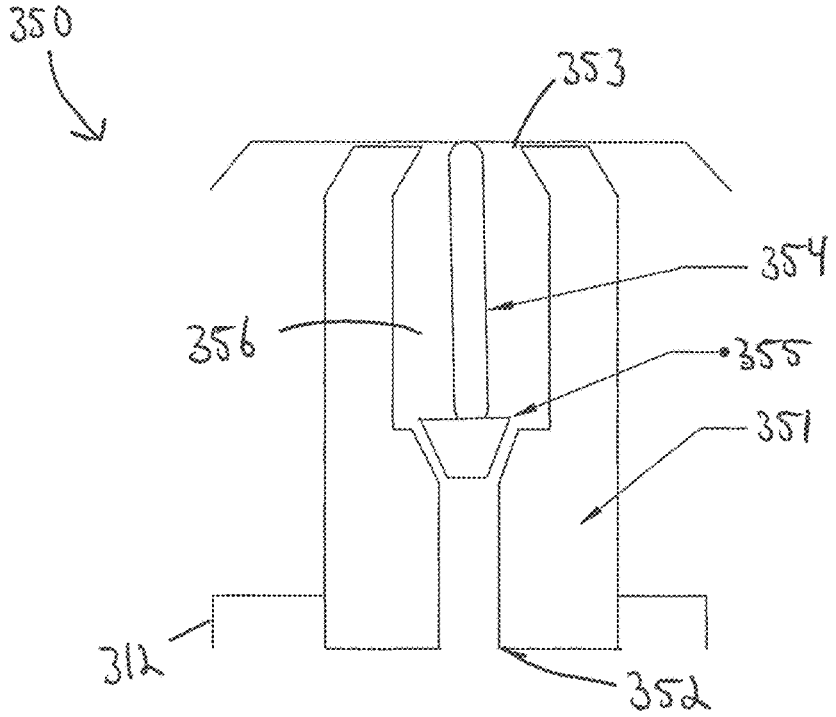
FIGS. 15A and 15B are cross-sectional views of a thermally-actuated fire sprinkler for use with a fire sprinkler system.
Figure 15B:
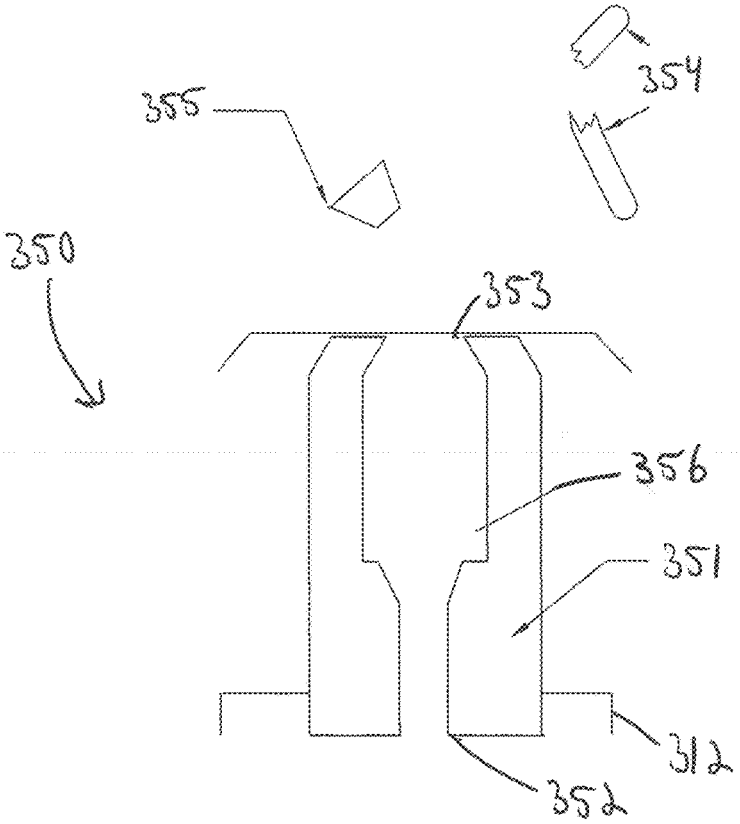

Referring to FIGS. 15A and 15B, each of the fire sprinklers may include a thermally-activated fire sprinkler 350. The fire sprinkler 350 has a body 351 with an inner passage 356 extending between an inlet 352 through which extinguishing fluid enters the inner passage 356 from the pipe 312, and an outlet 353 through which extinguishing fluid is conveyed from the fire sprinkler 350 to suppress the fire.

A frangible thermal bulb 354 helps to retain a valve core 355 within the inner passage 356 to obstruct the flow of air and extinguishing fluid when the system is in steady state operation, as shown in FIG. 15A. The thermal bulb 354 is designed to fracture or break when the ambient air temperature exceeds a design value that is indicative of the fire condition. Once the thermal bulb 354 fractures, its pieces and the valve core 355 are expelled, or fall due to gravity when the fire sprinkler 350 has an inverted orientation, via the outlet 353. The inner passage 356 no longer has any impediments blocking the flow of fluid therethrough. The fire sprinkler 350 has therefore actuated, and has created a path between the pipe 312 and the surrounding air. As a result, ambient air may now flow through the inner passage 356, and the air flow rate in the pipe 312 will shift in response to the change in the pipe openings. This difference in flow rate value is measured by the control unit, which opens the valve allowing extinguishing fluid from the pressurized source to fill the pipe 312 if the difference exceeds the predetermined delta value. Extinguishing fluid in the pipe 312 will cause the selective flow ports to close, preventing discharge of the extinguishing fluid from these devices, as explained above. The extinguishing fluid will also exit through any fire sprinklers 350 which have opened.

The system 300 disclosed herein helps to lower delivery time of the extinguishing fluid, a significant factor in dry pipe systems. Indeed, since the starting pressure in the pipe 312 when the valve 320 opens is substantially atmospheric pressure, the resistive pressure that the extinguishing fluid needs to overcome to fill the pipe 312 is lower than conventional systems, which allows the pipe 312 to be filled quicker. Furthermore, the selective flow ports 328 serve to vent air 311 from the system 300, which allows incoming extinguishing fluid to reach open sprinkler heads more quickly.

Furthermore, the use of a blower 332, which is a simpler device than the nitrogen generator used in some conventional systems, helps to reduce noise and cost since there is no need to replace depleted pressurized gas containers. It is also possible to heat the air 311 within the pipe 312, such as with a heater which can be incorporated into the blower 332, to reduce the dew point of the circulating air 311 and further improve the drying action of the air 311 within the pipe 312. Mandatory hydraulic testing of sprinkler systems which leaves liquid water in the pipes can contribute to microbiologically influenced corrosion (MIC) and galvanic corrosion. Removing moisture from the pipe 312 helps to mitigate these sources of corrosion.

While they are adapted to deliver water, it should be understood that the fire sprinkler systems 10, 200 and 300 illustrated in FIGS. 1, 10 and 11-13, respectively, may be adapted to discharge any adequate extinguishing liquid. For example, the water source 16,316 may be replaced by a source of adequate foam solution, such as a mixture of water and low expansion foam concentrate for example. For example, the foam solution may comprise about 1% foam agent and about 99% water. In another example, the foam solution may comprise about 6% foam agent and about 94% water.

While in FIGS. 1 and 10 the air sampling detector 22 is connected to the pipe 24 via the anti-flood device 30, it should be understood that the anti-flood device 30 may be omitted and/or the air sampling detector may be positioned at any other adequate locations within the system 10, 200. For example, the air sampling detector 22 may be located at one end of pipe 12. In this case, an anti-flood device 30 may be inserted between the air sampling detector 22 and the pipe 12. In another example, the air sampling detector 22 may be located along the pipe 18 so that water flowing from the valve 20 passes through the air sampling detector 22 to reach the pipe 12. In this example, the system 10, 200 comprises no anti-flood device 30.

In one embodiment in which the system 10, 200 comprises no anti-flood device 30, the sampling detector 22 may be disposable. The sampling detector 22 is replaced each time it is damaged due to water or liquid infiltration therein.

While the present description refers to a fire sprinkler system discharging water, the present invention may be embodied as a clean agent system adapted to discharge a clean agent such as carbon dioxide, fluorinated ketone, a blend of inert gases, and the like. If it is gaseous and upon opening of the valve 20, the clean agent may exit the pipe 12 via the water discharging conduit of the sprinklers and the air sampling openings. The suction device 32 may also be stopped once the sampling detector 22 has detected a potential fire in order to reduce the amount of clean agent that reaches the sampling detector 22.

It should be noted that the present invention can be carried out as a method or can be embodied in a system or an apparatus. The embodiments of the invention described above are intended to be exemplary only. The scope of the invention is therefore intended to be limited solely by the scope of the appended claims.

The invention claimed is:

1. A fire sprinkler system in communication with a source of fire extinguishing fluid, the fire sprinkler system comprising:

a piping system having at least one dual-use pipe providing both an air opening and a fire extinguishing fluid conveying outlet, the at least one dual-use pipe having at least one air conveying opening;

a blower fluidly connected to the at least one dual-use pipe to provide a substantially continuous flow of ambient air through the at least one dual-use pipe, the ambient air entering or exiting the at least one dual-use pipe via the at least one air conveying opening;

a control unit fluidly connected to the at least one dual-use pipe to measure the flow of the ambient air therethrough, the control unit operable to detect a difference between a measured airflow rate value of the ambient air through the at least one dual-use pipe and a baseline airflow rate value of the ambient air, a fire condition being detected by the control unit when a difference between the baseline airflow rate and the measured airflow rate exceeds a predetermined delta value;

a selective flow valve mounted in sealed engagement about the air opening, the ambient air flowing freely through the selective flow valve into or out of the at least one dual-use pipe upon the difference between the baseline and measured airflow rate values not exceeding the predetermined delta value;

a valve disposed between the source of the fire extinguishing fluid and the at least one dual-use pipe, the valve being in communication with the control unit and operable to displace between an open position to fill the at least one dual-use pipe with the fire extinguishing fluid upon detection of the fire condition, and a closed position; and at least one automatic sprinkler fluidly connected to the at least one dual-use pipe for ejecting the fire extinguishing fluid from the at least one dual-use pipe upon detection of the fire condition, said at least one automatic sprinkler having a frangible component, the frangible component breaking to create a supplemental airflow path through the at least one automatic sprinkler between the at least one dual-use pipe and surrounding ambient air, the supplemental airflow path increasing the difference between the baseline and measured flow rate values beyond the predetermined delta value, and to eject the fire extinguishing fluid from said at least one automatic sprinkler upon an increase in temperature of the ambient air being indicative of the fire condition.

2. The sprinkler system as defined in claim 1, wherein the blower is operable to provide a unidirectional flow of ambient air through the at least one dual-use pipe, the ambient air entering the at least one dual-use pipe via the blower and exiting the at least one dual-use pipe via the at least one air opening.

3. The sprinkler system as defined in claim 1, wherein the fire extinguishing fluid is prevented from exiting the selective flow valve.

4. The sprinkler system as defined in claim 1, wherein the selective flow valve comprises an internal cavity having a first fluid passage adjacent to surrounding ambient air and a second fluid passage adjacent to the at least one dual-use pipe, a retainer, and a displaceable buoyant element, the retainer being fixed within the cavity to prevent displacement of the buoyant element from blocking the second fluid passage.

5. The sprinkler system as defined in claim 4, wherein the buoyant element is abutted against the first fluid passage by the fire extinguishing fluid upon the fire extinguishing fluid entering the internal cavity.

6. The sprinkler system as defined in claim 1, wherein the frangible component of said at least one automatic sprinkler includes a frangible thermal bulb and a valve core, the frangible thermal bulb breaking and the valve core being expelled from the at least one automatic sprinkler upon the increase in temperature of the ambient air being indicative of the fire condition.

7. The sprinkler system as defined in claim 6, wherein the ambient air flows into or out of said at least one automatic sprinkler upon the frangible thermal bulb breaking and the valve core being expelled, said flow of the ambient air through said at least one automatic sprinkler increasing the difference between the baseline and measured airflow rate values beyond the predetermined delta value.

8. The sprinkler system as defined in claim 1, wherein the air opening is spaced apart on the at least one dual-use pipe from the at least one automatic sprinkler.

* * * * *